US007407403B2

(12) United States Patent
Tanaka et al.

(10) Patent No.: US 7,407,403 B2
(45) Date of Patent: Aug. 5, 2008

(54) CONNECTOR

(75) Inventors: Nobuyoshi Tanaka, Yokkaichi (JP); Yoji Kanaoka, Wako (JP); Takayuki Nakatsugawa, Wako (JP)

(73) Assignees: Sumitomo Wiring Systems, Ltd (JP); Honda Motor Co., Ltd (JP)

( * ) Notice: Subject to any disclaimer, the term of this patent is extended or adjusted under 35 U.S.C. 154(b) by 0 days.

(21) Appl. No.: 11/338,010

(22) Filed: Jan. 24, 2006

(65) Prior Publication Data

US 2006/0166545 A1 Jul. 27, 2006

(30) Foreign Application Priority Data

Jan. 26, 2005 (JP) ..... P2005-018355

(51) Int. Cl.
*H01R 13/627* (2006.01)

(52) U.S. Cl. ..... 439/358; 439/354

(58) Field of Classification Search ..... 439/350, 439/353–354, 357–358

See application file for complete search history.

(56) References Cited

U.S. PATENT DOCUMENTS

| | | | | |
|---|---|---|---|---|
| 4,946,404 | A | 8/1990 | Takenouchi et al. | |
| 4,950,179 | A | 8/1990 | Takenouchi et al. | |
| 5,496,190 | A * | 3/1996 | Ittah et al. | 439/354 |
| 6,676,433 | B1 * | 1/2004 | Ozaki | 439/353 |

* cited by examiner

*Primary Examiner*—Felix O. Figueroa
(74) *Attorney, Agent, or Firm*—Gerald E. Hespos; Anthony J. Casella

(57) ABSTRACT

A male housing (1) has a hood (5) for receiving a female housing (2) and the female housing (2) has a locking arm (9) for engaging the hood (5) when the housings (1, 2) are fit together. Protection walls (19) are formed on the female housing (2) on opposite sides of the locking arm (9). The protection walls (19) are substantially flush with the hood (5) when the housings (1, 2) are fit together. An operation portion (20) of the locking arm (9) also is substantially flush with the hood (5) when the housings (1, 2) are fit together. A predetermined interval is set between opposed ends of the protection wall (19) and the hood (5) and between the operation portion (20) and the hood (5). Thus, an operator's gloves will not be caught while fitting the male and female housing (1, 2) together.

5 Claims, 9 Drawing Sheets

CONNECTOR

BACKGROUND OF THE INVENTION

1. Field of the Invention

The invention relates to a connector for connecting electric wires to each other.

2. Description of the Related Art

U.S. Pat. No. 4,946,404 and U.S. Pat. No. 4,950,179 disclose a connector assembly with female and male housings. The male housing has a square pillar shaped hood and the female housing can fit into the hood of the male housing. A locking arm is formed on an upper surface of the female housing and can be locked to the hood for holding the housings together in a locked state. An operation portion is formed on the lock arm and can be used to deflect the lock arm so that the housings can be separated. A protection wall is erected at both sides of the locking arm in a widthwise direction to prevent an inadvertent operation of the lock arm that could separate the housings unintentionally.

The present tendency is to make connectors compact. However, it is necessary to erect the protection wall to almost the same level as the operation portion of the locking arm. Additionally, the protection walls project out laterally from side surfaces adjacent to the surface of the female housing on which the locking arm is formed. Therefore it is difficult to achieve a specified compact width of the surface of the female housing on which the locking arm is formed.

As described above, the protection walls are project laterally out. Consequently the side surface of the hood and the side surface of the protection wall become almost flush with each other when the female housing is fit in the male housing. The above-described connector has a problem in that an operator's gloves are caught in the space between the male and female housings, namely, between an end surface of an opening of the hood and a front end of the protection wall when a fit-in operation is performed. As a result, work efficiency deteriorates. Such being the case, measures for solving the problem are demanded.

SUMMARY OF THE INVENTION

The present invention has been completed in view of the above-described situation. Therefore it is an object of the invention to provide a connector having a construction in which operator's gloves are prevented from being caught in a space between a front end of a female housing and a front end of a male housing while fitting the female housing in the male housing.

The invention relates to a connector with a first housing that has a hood and a second housing that can fit in the hood. When the second housing is fit in the first housing, a flush portion of the second housing becomes almost flush with an outer surface of the hood. The flush portion is spaced at a predetermined interval from an end surface of an opening of the hood.

A flexible locking arm preferably is formed on an upper surface of the second housing and can be locked to the hood when the second housing is fit in the first housing. Thus, the first and second housings are locked together in a fit-in state. A rear end of the locking arm projects up and an operation surface is formed at the upper surface at the rear of the locking arm. The operation surface has a flush portion that allows an operation of releasing a state in which the first and second housings are locked together. The operation surface bulges in a circular arc shape towards the end surface of the opening of the hood.

Two protection walls project on both lateral side surfaces adjacent to a surface of the second housing on which the locking arm is formed so that the locking arm is between the protection walls. The protection walls become flush with the outer surfaces of the hood. A front edge of each of the protection walls is rearward from the operation surface. A cut-off portion is formed at a corner disposed at an upper end of a front portion of the protection wall.

The second housing of the above-described connector is fit in the first housing so that the flush portion of the second housing becomes almost flush with the outer surface of the hood. However, the flush portion is spaced from the end surface of the opening of the hood by a predetermined distance. Therefore, an operator's gloves will not be caught between the flush portion and the end surface of the opening of the hood.

The first and second housings are locked together in a fit-in state by locking the locking arm to the hood. Additionally, the operation surface of the locking arm is almost flush with the upper surface of the locking convexity of the hood. The operation surface is operated to separate the male and female housings from each other. The operation surface bulges towards the end surface of the opening of the hood to increase the area of the operation surface. Accordingly, unlocking efficiency is excellent. This construction causes the operation surface to come close to the end surface of the opening of the hood during a fit-in operation, and there is a fear that the operator's gloves will catch between the operation surface and the end surface of the opening of the hood when the fit-in operation is performed. However, the front end of the operation surface is a circular arc-shape. Thus, the area between the front end of the operation surface and the end surface of the opening of the hood is very small when the operation surface comes close to the end surface of the opening of the hood. Therefore, the operator's gloves are not likely caught therebetween.

The protection wall prevents the operation surface from being operated inadvertently to unlock the locking arm from the locking edge of the first housing when the second housing is fit in the first housing. Additionally, the cut-off corner at the upper end of the front portion of the protection wall prevents the operation surface from interfering with the protection wall during an unlocking operation.

DETAILED DESCRIPTION OF THE PREFERRED EMBODIMENTS

Figure 1:
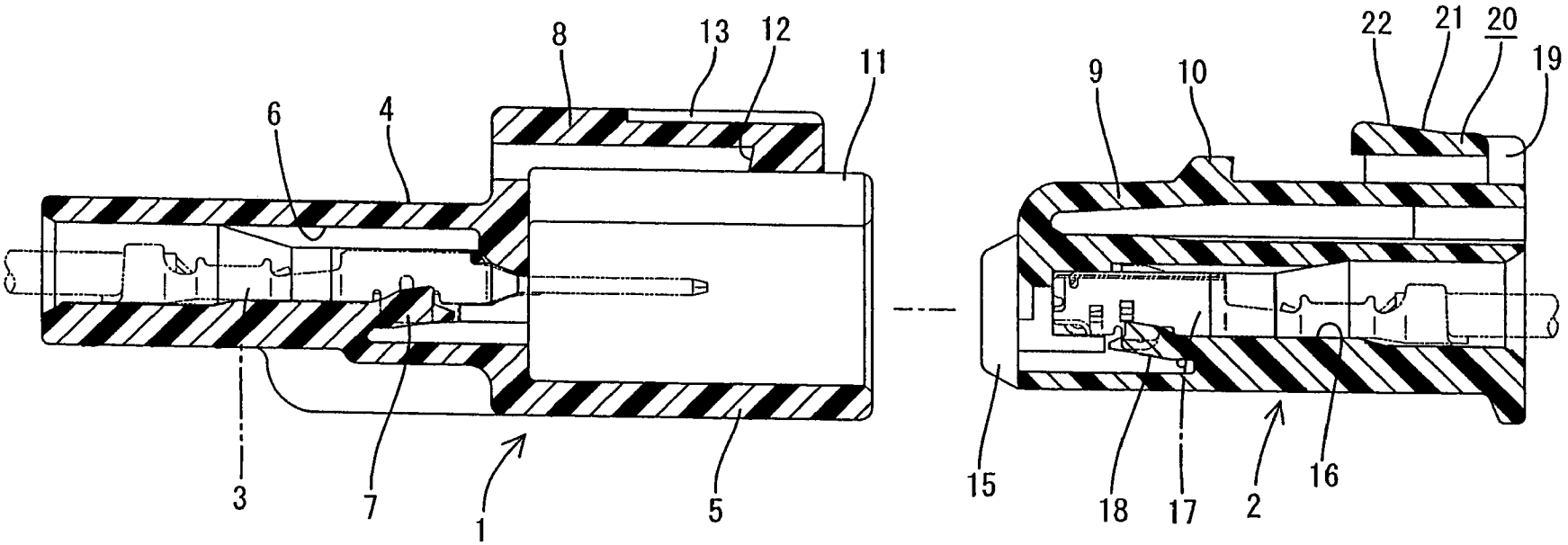
FIG. 1 is a sectional view of a female housing opposed to a male housing.
Figure 2:
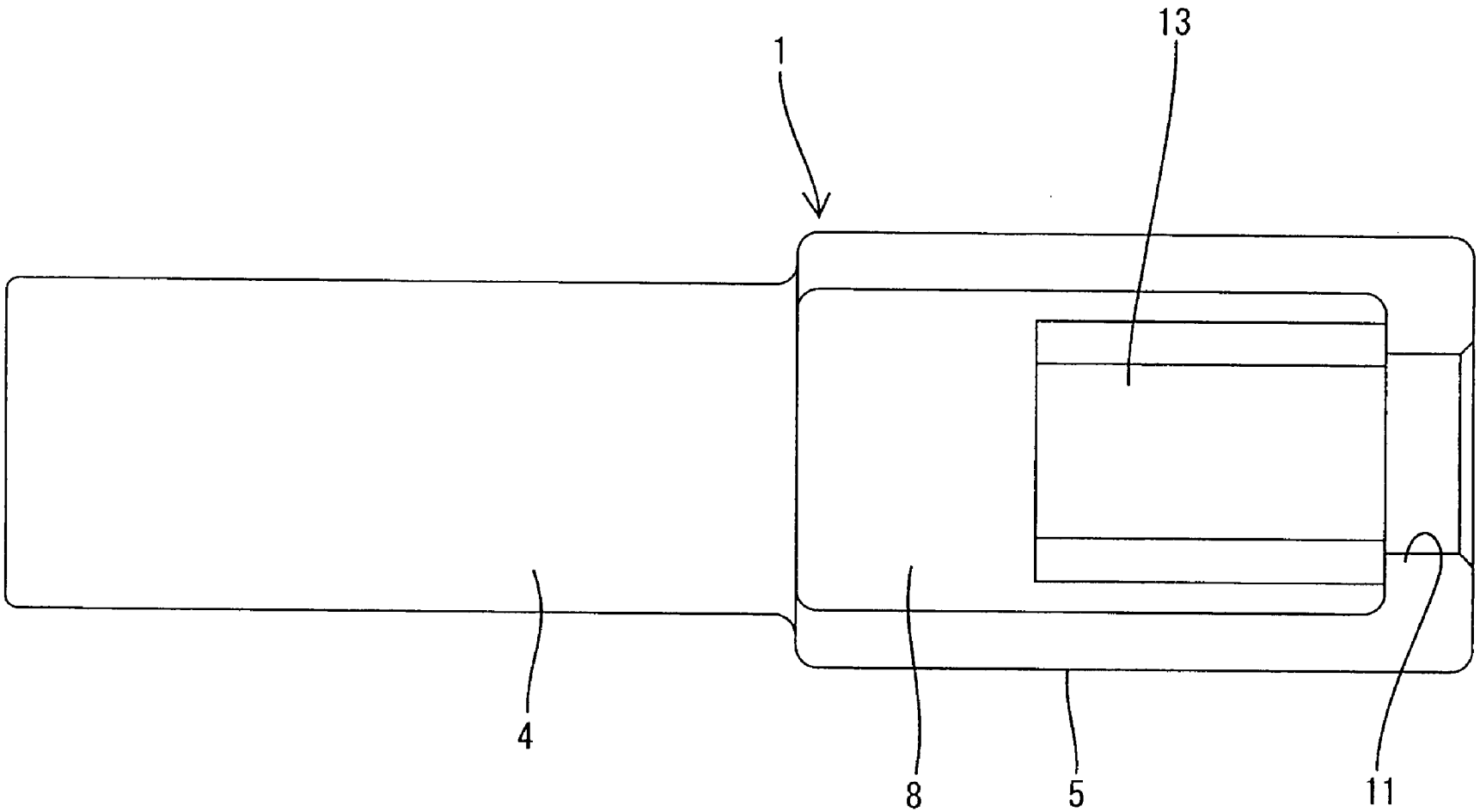
FIG. 2 is a plan view showing the male housing.

A connector in accordance with the invention is illustrated in FIGS. 1 to 9. The connector includes a male housing 1 and a female housing 2, each of which is made of synthetic resin. Male terminal fittings 3 are accommodated in a terminal accommodation part 4 formed in a rear part of the male housing 1. The male housing 1 also includes a square pillar-shaped hood 5 that projects forward from the terminal accommodation part 4. The hood 5 is configured for receiving the female housing 2. Two cavities 6 are arranged side-by-side inside the terminal accommodation part 4 of the male housing 1 and penetrate through the terminal accommodation part 4 in a longitudinal direction of the male housing 1. A vertically flexible lance 7 is formed in a front portion in each cavity 6 for locking the male terminal fitting 3.

A locking convexity 8 is formed at a widthwise central portion of an upper surface of the hood 5 of the male housing 1 and extends in the longitudinal direction of the male housing 1. The locking convexity 8 extends from a position slightly rearward from a front end surface of an opening of the hood 5 to a rear end of the hood 5. An upper portion of the hood 5 is recessed from the end surface of the opening of the hood 5 to a position slightly forward from a rear end of the locking convexity 8 to define an escape opening 11. A locking edge 12 is formed on an inner surface of a front end of the locking convexity 8 and a concavity 13 is formed at a front portion of an upper surface of the locking convexity 8.

Figure 3:
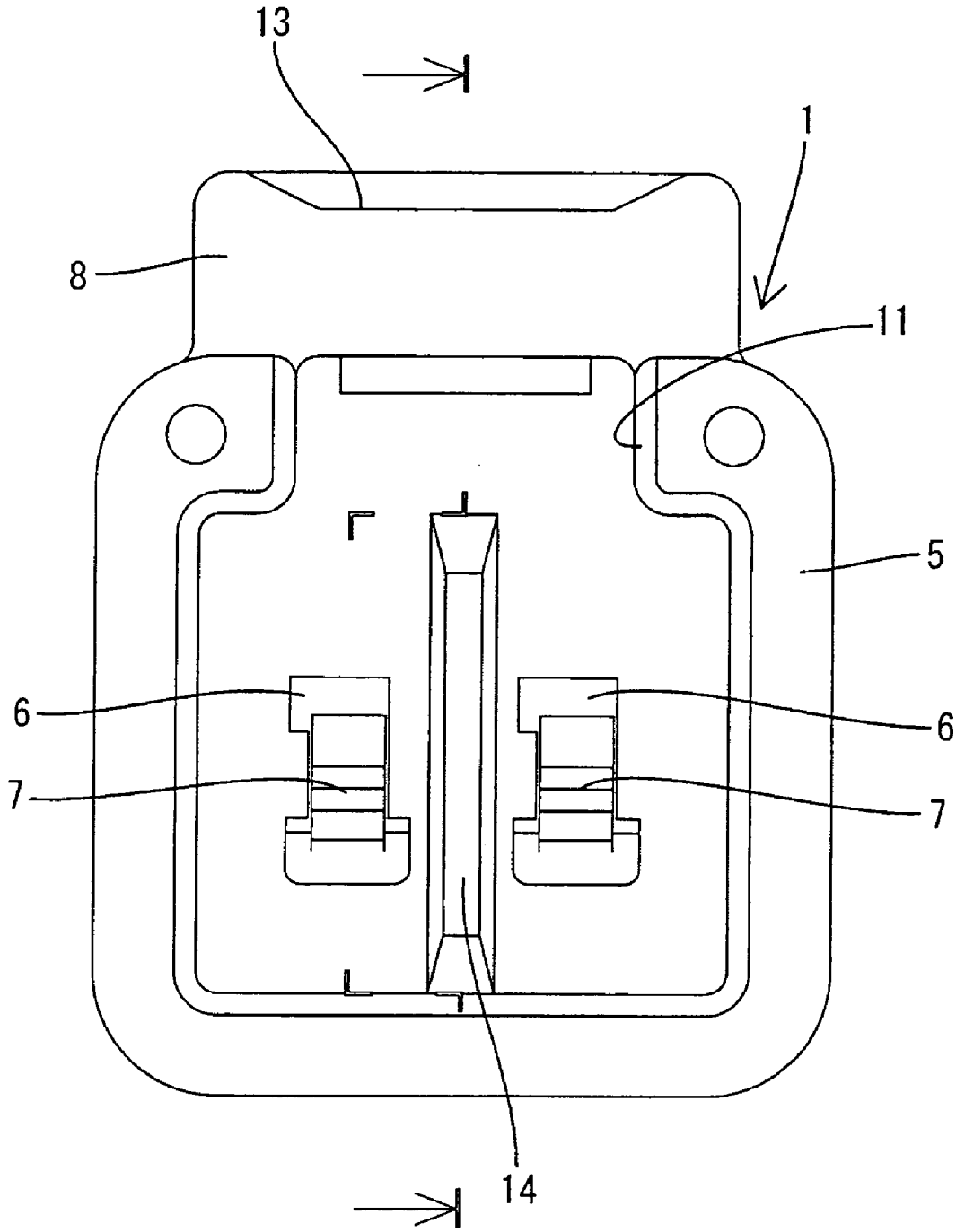
FIG. 3 is a front view showing the male housing.

As shown in FIG. 3, a vertical groove 14 is formed in a rear wall of the hood 5 between both cavities 6.

Figure 4:
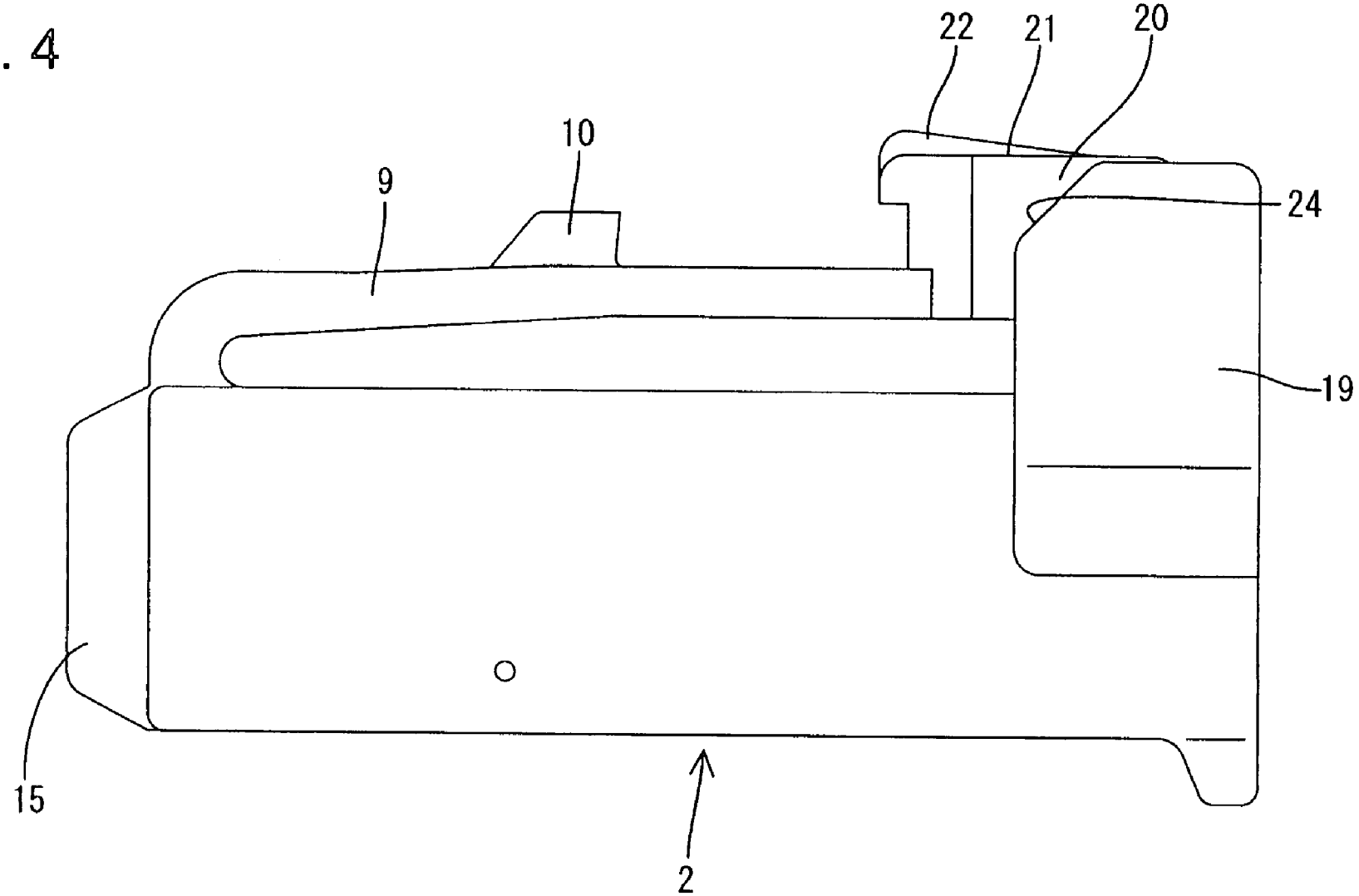
FIG. 4 is a side view of the female housing.
Figure 5:
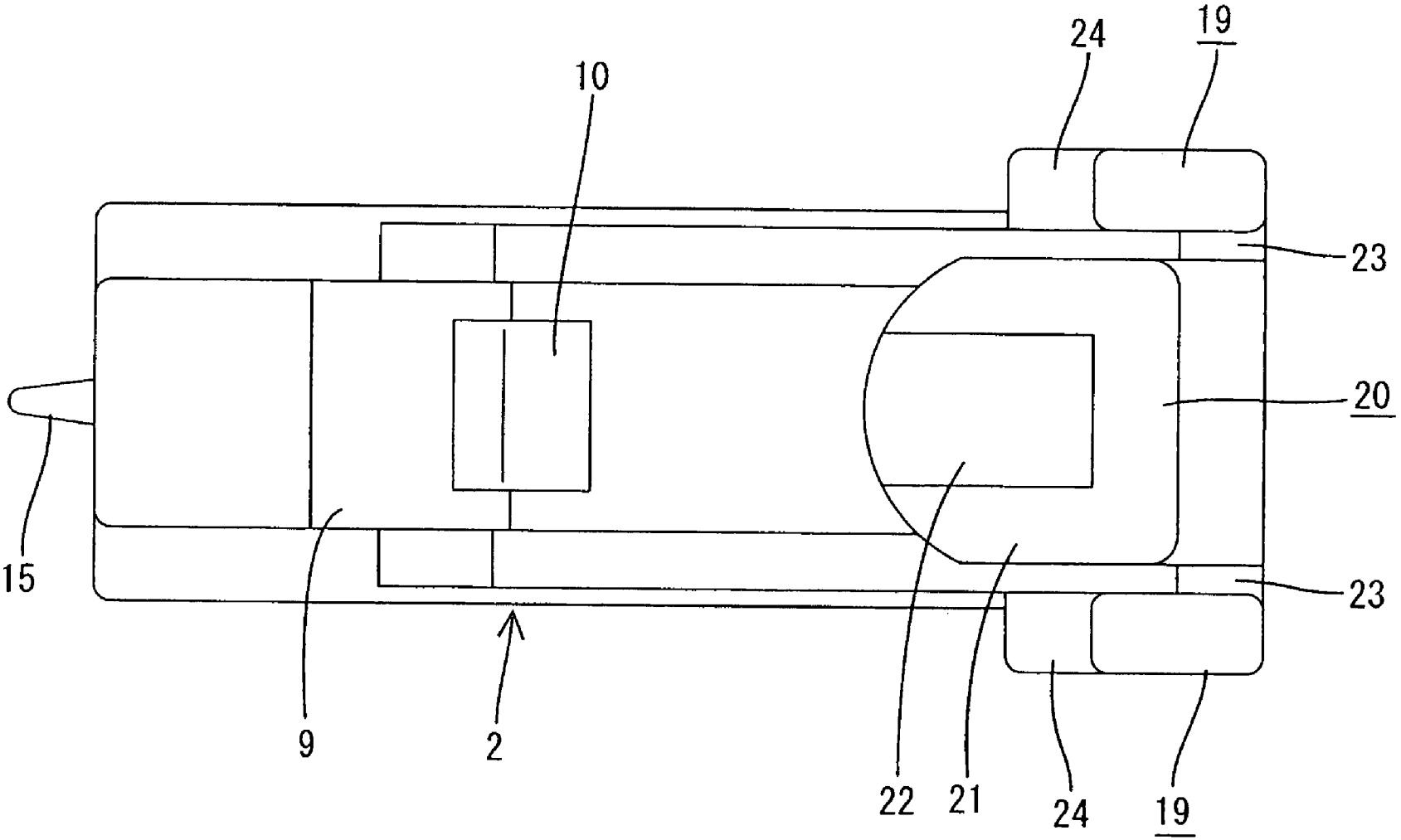
FIG. 5 is a plan view showing the female housing.

The female housing 2 is shown most clearly in FIGS. 1, 4, 5, and 6. More particularly, the female housing 2 is formed integrally of a synthetic resin and has a generally block shape configured for fitting in the hood 5. Two substantially side-by-side cavities 16 are formed in the female housing 2 and are configured to receive female terminal fittings 17. A vertically flexible lance 18 is formed in each cavity 16 for locking the female terminal fitting 17 therein. A vertical rib 15 projects forwardly from the space between the cavities 16 and is configured for fitting in the vertical groove 14 of the male housing 1. The front edge of the rib 15 is tapered, as shown in FIG. 5.

A locking arm 9 is formed on an upper surface of the female housing 2 for locking the female housing 2 in a fitted state in the male housing 1. The locking arm 9 extends longitudinally from a front end of the female housing 2 to a rear end thereof, with the front end of the female housing 2 operating as a support at one end of the locking arm 9. Protection walls 19 join a rear end of the locking arm 9 to the rear end of the female housing 2. Thus, the locking arm 9 is levered doubly so that a central longitudinal portion of the locking arm 9 is vertically elastically deformable.

A locking projection 10 is formed at a longitudinal central portion of the upper surface of the locking arm 9. The locking projection 10 is locked with the locking edge 12 of the male housing 1 when the female housing 2 is fit in the male housing 1 to a predetermined normal position for holding the male and female housings 1 and 2 in a fit-in state. An arch-shaped operation portion 20 is formed in near the rear end of the locking arm 9. An operation surface 21 is formed at the top of the operation portion 20 and can be pressed to release a locked state of the locking arm 9. The operation surface 21 is almost flush with the upper surface of the locking convexity 8 when the female housing 2 is fit normally in the male housing 1. Thus the operation surface 21 constitutes a flush portion of the present invention. A front end of the operation surface 21 is spaced at a predetermined interval from the front end of the hood 5, and specifically from the front end of locking convexity 8, when the female housing 2 is fit normally in the male housing 1. The predetermined interval is set to so that gloves are not caught between the front end of the operation surface 21 and the front end of the locking convexity 8, and preferably is at least about 1-5 mm, and most preferably about 2 mm.

Figure 8:
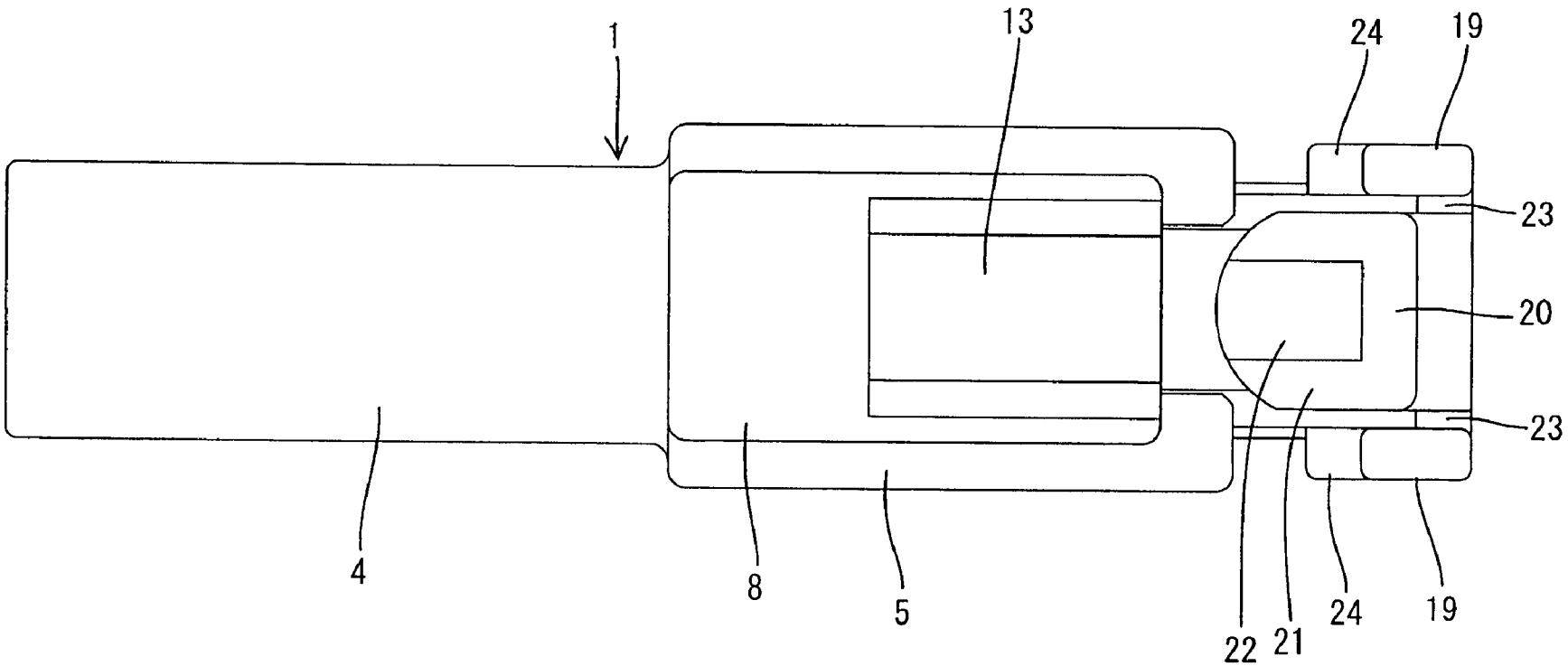
FIG. 8 is a plan view of the female housing fit in the male housing.
Figure 9:
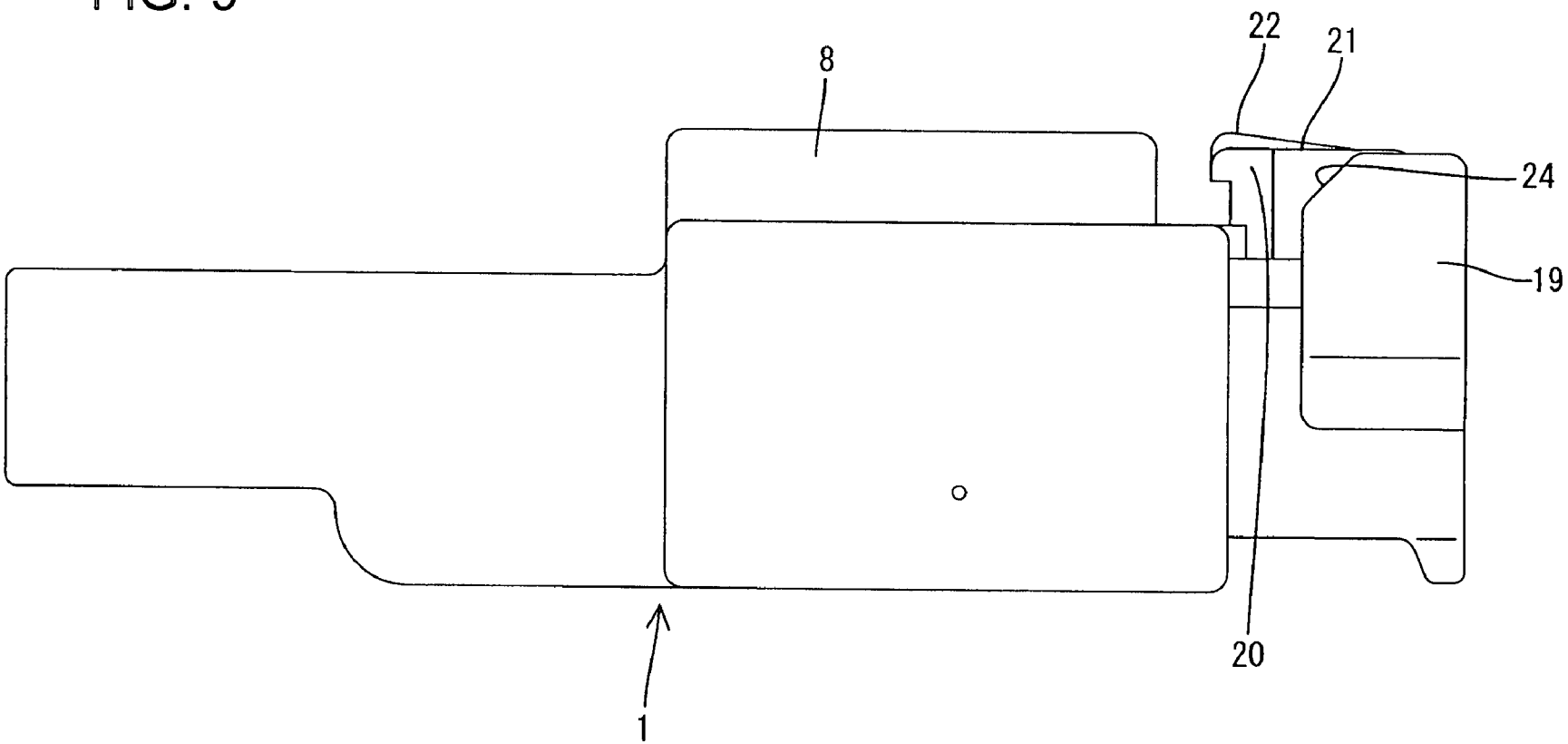
FIG. 9 is a side view of the female housing fit in the male housing.

The front-end of the operation surface 21 is arch-shaped and bulges towards the locking convexity 8, as shown in FIGS. 5 and 8 to secure a largest possible area for the operation surface 21,. Consequently the longitudinal interval between the front end of the operation surface 21 and that of the locking convexity 8 is short. However, the circular arc shape of the front end of the operation surface 21 projects the central portion of the front end of the operation surface 21 forward to a substantially maximum extent. Thus, gloves effectively are prevented from being caught between the front end of the operation surface 21 and the front end of the locking convexity 8. The operation surface 21 is not formed as a single horizontal plane, but rather an inclined projection 22 is formed on the widthwise central portion of the operation surface 21 in its widthwise direction. The inclined projection 22 slopes gradually up towards the front end of the operation surface 21. As described above, the entire locking arm 9 is levered doubly by the supports at the front and rear ends, and the locking projection 10 is forward of the operation surface 21. The upward and forward slope of the inclined projection 22 facilitates the application of a pressing force on the operation surface 21 for downwardly deforming the locking arm 9 sufficiently to disengage the locking projection 10 from the locking edge 12.

Figure 6:
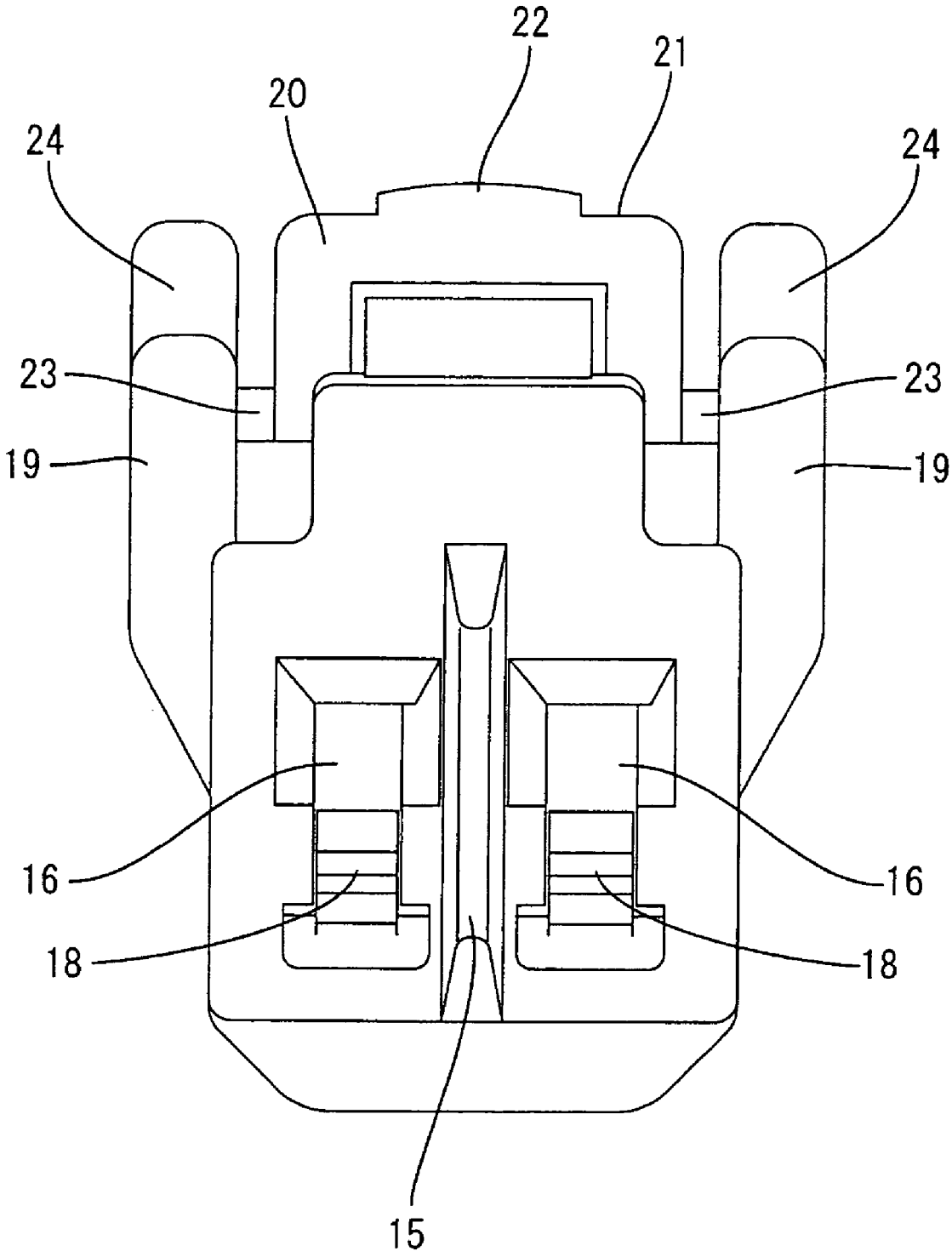
FIG. 6 is a rear view showing the female housing.
Figure 7:
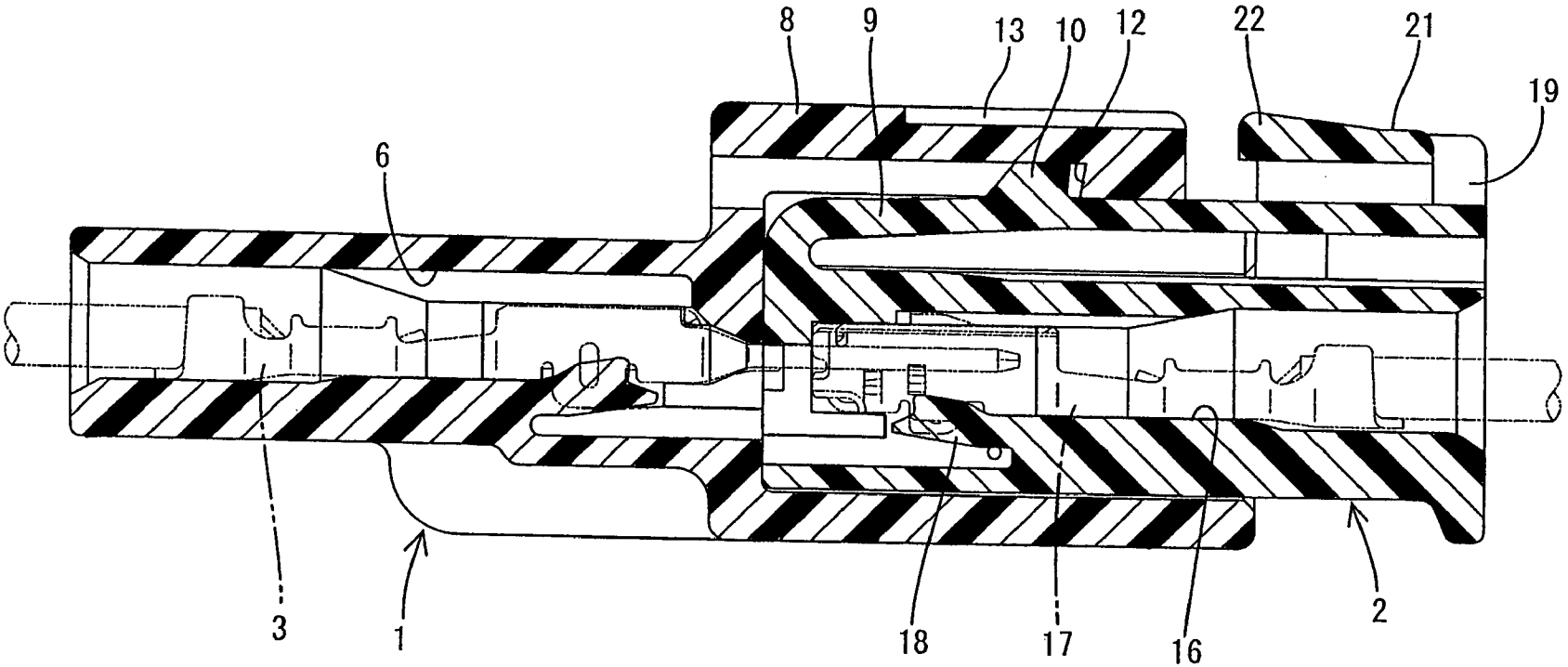
FIG. 7 is a sectional view of the female housing fit in the male housing.

The protection walls 19 are formed at opposite sides of the rear end of the locking arm 9 and effectively sandwich the operation portion 20, as shown in FIGS. 5, 6, and 8, to prevent the locking arm 9 from being unlocked inadvertently. Additionally, the protection walls 19 are disposed outward from the side surface of the female housing 2 and upward from a central position in the vertical direction of both side surfaces of the female housing 2. A rear end of each protection wall 19 is almost flush with the rear end of the female connector housing 2. Connection pieces 23 join inner surfaces of the rear end of the respective protection walls 19 to the rear end of the locking arm 9. Thus, the locking arm 9 is levered doubly by the support disposed at the front end and the connection pieces 23 at the rear end.

Outer side surfaces of the protection walls 19 are substantially flush with outer side surfaces of the hood 5 when the male and female housings 1 and 2 are fit together normally. Thus the outer side surface of each protection wall 19 constitutes a flush portion of the present invention. Front ends of the protection walls 19 are spaced a predetermined interval from the end surface of the opening of the hood 5 when the female housing 2 is fit normally in the male housing 1. This interval is set so that gloves will not be caught between the front end of the protection wall 19 and the end surface of the opening of the hood 5. The interval preferably is about 2-10 mm and most preferably about 5 mm. An upper end of each protection wall 19 is horizontal and almost flush with the upper surface of the locking convexity 8 and the operation surface 21. Therefore the inclined projection 22 is slightly higher than the upper end of the protection wall 19. More specifically the inclined projection 22 is above an upper surface of the concavity 13, when the female housing 2 is fit normally in the male housing 1. As shown in FIG. 4, a front upper corner of each protection wall 19 is cut off at a slant to form a cut-off portion 24. An upper end of the inclined surface of the cut-off portion 24 is coincident with a rear end of the inclined projection 22 formed on the operation surface 21 to prevent the protection wall 19 from interfering with the operation surface 21 in performing the operation of unlocking the locking arm 9 from the locking edge 12.

The female housing 2 can be fit in the hood 5 of the male housing 1. As a result, the locking arm 9 deforms elastically and passes under the front end of the locking convexity 8. The locking arm 9 then returns elastically and locks to the locking edge 12. Thus, the male and female housings 1 and 2 are locked together in a normal fit-in state, and the male and female terminal fittings 3 and 17 are connected to each other normally.

The outer side surfaces of the protection walls 19 and the outer surfaces of the hood 5 become almost flush with each other when the female housing 2 is fit normally in the male housing 1. Similarly, the upper surfaces of the operation portion 20 and the locking convexity 8 become almost flush with each other when the female housing 2 is fit normally in the male housing 1. A sufficient longitudinal distance is set for between these two outer side surfaces and between these two upper surfaces. Thus, gloves will not be caught at any of the above-described spaces while fitting the male and female housings 1 and 2 together and operational efficiency is improved.

The operation surface 21, including the inclined projection 22, is pressed to separate the male and female housings 1 and 2. As a result, the longitudinal central part of the locking arm 9 is displaced down and the locking projection 10 is unlocked from the locking edge 12. The inclined projection 22 slopes up towards the front. Hence, an operator can easily apply a forward pressing force to the operation surface 21 and easily can displace portions of the locking arm 9 near the locking projection 10. Further the cut-off portion 24 is formed at the upper front corner of the protection wall 19. Thus, the protection wall 19 does not interfere with the operation surface 21 when the operator uses his or her fingers to press the operation surface 21. The male and female housings 1 and 2 can be pulled apart and separated when the locking projection 10 is unlocked from the locking edge 12.

The connector is compact because the female housing 2 does not project out from the hood 5 of the male housing 1 when the female housing 2 is fit normally in the male housing 1. Further the flush portion is spaced at the predetermined interval from the hood 5. Thus, gloves will not be caught between the male and female housings 1 and 2 and assembly and connection are efficient. The front-end of the operation portion 20 bulges towards the hood 5 to increase the operation area of the operation portion 20 of the locking arm 9 and to assure efficient operation. Further the arc shape of the front-end of the operation surface 21 prevents gloves from being caught. Furthermore the inclined projection 22 on the operation surface 21 facilitates deflection of the doubly levered locking arm 9 for unlocking. In addition, the cut-off portion 24 on the protection wall 19 prevents the protection wall 19 from interfering with the operation portion 20 during the operation of unlocking the locking arm 9 from the locking edge 12.

The invention is not limited to the embodiment described above with reference to the drawings. For example, the following embodiments are included in the technical scope of the present invention. Further, various modifications of the embodiments can be made without departing from the spirit and scope of the present invention.

In the first embodiment, the protection wall and the operation portion of the locking arm are set as the flush portion, but only one of the protection wall and the operation portion may be set as the flush portion. Further the flush portion is not necessarily limited to the protection wall and the operation portion.

The locking arm is not necessarily of a doubly levered type but may be of a cantilevered type.

What is claimed is:

1. A connector comprising:

a first housing having opposite front and rear ends, a forwardly open hood formed substantially adjacent the front end, the hood including opposed side walls and a locking wall extending between the side walls, the locking wall having a recessed front edge spaced rearwardly from the front end of the first housing and a rearwardly facing locking edge formed on the locking wall and facing into the hood; and a second housing having a front end configured for insertion into the hood and a rear end configured for disposition outside the hood, a resiliently deflectable locking arm extending in a front to rear direction on the second housing, a locking projection formed at an intermediate position on the locking arm and configured for engaging the locking edge when the housings are fit together, protection walls formed on opposite sides of the locking arm and spaced rearward of the front end of the second housing, upper front corners of the protection walls being cut off and slopping down in a rear-to-front direction, outer side surfaces of the protection walls being substantially flush with the hood and front edges of the protection walls being spaced rearwardly from the side walls of the hood when the housings are fit together, the locking arm having an operation portion with a convexly arcuate front edge extending partly towards the recessed front edge of the locking wall of the hood, the front edge of the operation portion being spaced from the hood, the operation portion having an operation surface facing upwardly and away from remaining parts of the second housing, the operation surface including an inclined projection having a front end substantially at a front end of the operation portion and forwardly of the cut off corners of the protection walls, the operation portion further having a rear end substantially aligned with rear ends of the cut-off corners of the protection walls, whereby the cut-off front corners of the protection walls prevent the protection walls from interfering with exertions of pressing forces on the inclined projection for deflecting the lock arm, and whereby the spacing of the front edges of the protection walls from the side walls of the hood and the spacing of the operation portion of the locking arm from the hood prevent gloves of a worker from being pinched between the first and second housing during insertion of the front end of the second housing into the hood.

2. The connector of claim 1, wherein the front edges of the protection walls are spaced from the side walls of the hood by about 2-10 mm.

3. The connector of claim 1, wherein the front edge of the operation portion is spaced from the hood by about 5 mm.

4. The connector of claim 1, wherein the locking arm has a front end joined unitarily to the second housing and a rear end joined unitarily to the protection walls.

5. The connector of claim 1, wherein rear portions of the inclined projection are above the cut off upper front corners of the protection walls when the lock arm is in an undeflected condition.

* * * * *